US005175516A

United States Patent [19]

Walsh et al.

[11] Patent Number: 5,175,516

[45] Date of Patent: Dec. 29, 1992

[54] WAVEGUIDE TERMINATION

[75] Inventors: Arthur L. Walsh, Westford, Mass.; Barry E. Genereux, Pascoag, R.I.

[73] Assignee: Raytheon Company, Lexington, Mass.

[21] Appl. No.: 682,815

[22] Filed: Apr. 9, 1991

[51] Int. Cl.[5] ..... H01P 1/26

[52] U.S. Cl. ..... 333/22 F; 333/81 B

[58] Field of Search ..... 333/22 R, 22 F, 81 B; 342/1-4; 338/216

[56] References Cited

U.S. PATENT DOCUMENTS

| | | | |
|---|---|---|---|
| 2,892,157 | 6/1959 | Schlansker et al. | 333/81 B X |
| 2,922,963 | 1/1960 | Beatty | 333/22 R |
| 4,516,088 | 5/1985 | Johnson et al. | 333/22 F |
| 4,638,268 | 1/1987 | Watanabe et al. | 333/22 F |

FOREIGN PATENT DOCUMENTS

| | | | |
|---|---|---|---|
| 1083260 | 3/1984 | U.S.S.R. | 333/22 F |

*Primary Examiner*—Paul Gensler

*Attorney, Agent, or Firm*—Denis G. Maloney; Richard M. Sharkansky

[57] ABSTRACT

A liquid cooled adjustable waveguide termination for use in high power applications is described. The liquid cooled adjustable termination includes a waveguide housing having a shorting plate disposed at an end portion of the housing and an electromagnetic energy absorbent element disposed within the waveguide. The absorbent element includes a hollow tube disposed within a bore of the element for providing the liquid coolant to an inner portion of the element. The termination further includes a flow header assembly for providing coolant to the absorbent element via the hollow tube and for directing the heated coolant out of the termination assembly, and an adjustable seal plate disposed between the flow header assembly and the shorting plate for adjusting the position of the electromagnetic energy absorbent element within the waveguide.

14 Claims, 2 Drawing Sheets

WAVEGUIDE TERMINATION

BACKGROUND OF THE INVENTION

This invention relates generally to waveguide terminations and more particularly to high-power waveguide terminations.

As is known in the art, a waveguide termination or load is a one-port device that is commonly used to absorb electrical power incident upon it. Ideally, it is desired to have the impedance of the termination be equal to the characteristic impedance of the transmission media to which it is coupled to so that all of the incident power is absorbed.

Waveguide terminations generally include a lossy, usually resistive element disposed within the inner portion of the waveguide which absorbs the electrical energy and a shorting plate disposed at one end of the waveguide for preventing radiation leakage out of or into the waveguide structure. The other end of the waveguide is open and generally includes a flange. The flange includes mounting holes for allowing the connection of the termination to other waveguide components. To minimize reflections at the joint, the mating surfaces must be clean and flat and the adjoining waveguides must be properly aligned. The flanges are bolted together so that the mating surfaces make good ohmic contact, particularly at points along the broad walls of the waveguide, where longitudinal currents flow. In operation, electromagnetic energy enters the flanged end of the waveguide and is absorbed by the lossy element.

In high power applications, an effective connection between waveguides may be provided by using a choke flange. The cover-to-choke flange configuration is preferred in high power applications because the ohmic contact occurs at a minimum current point, thus arcing is avoided even if the contact is imperfect and erratic. The principle of operation of a choke flange is similar to that of a noncontacting short. The choke flange typically includes a circular groove disposed at a distance from the center of the waveguide and a transformer line section coupled to the groove which provides in combination a low impedance at the waveguide wall, thus providing continuity of longitudinal current flow between the waveguides.

There are a wide variety of waveguide terminations having elements with different sizes, shapes and material compositions generally dependent on the particular application and the frequency of operation.

One waveguide termination used when low standing wave ratios are required is the tapered load. The tapered load generally has a lossy element disposed within the waveguide which is gradually tapered to minimize wave reflections. The length of the taper for the lossy element is generally required to be at least a few wavelengths long at the lowest frequency of operation. The taper of the lossy element generally begins in intimate contact with the narrow walls of the guide where the electric field is negligible. This configuration minimizes the possibility of electrical arcing between the narrow walls of the waveguide at high power levels.

In higher power applications, forced air or liquid cooling may be required. In applications using air cooling, the waveguide housing generally includes finned portions for providing a greater surface area for radiating heat conducted from the tapered load to the waveguide walls and an optional fan for carrying away heated air from the finned portions.

Liquid cooled tapered load waveguide terminations generally include channels carrying a circulating coolant which is rigidly fixed to the waveguide housing for transferring heat out of the termination assembly. Because the load element is required to withstand high temperatures, ceramic based absorbing materials are commonly used. Although ceramic materials are generally refractory, their dielectric constant and loss tangent characteristics are also relatively temperature sensitive. Therefore, for very high power applications cooling methods are generally required.

A waveguide termination used in very high power applications is the ceramic block window load. One type of ceramic block window load includes a hollow waveguide having a fluid-tight coolant chamber portion disposed within an end portion of the waveguide and adjacent to the shorting plate of the termination. The liquid coolant acts as the resistive element and provides the lossy medium required for absorbing the electromagnetic energy. The coolant chamber portion generally includes a partition or baffle disposed generally along the central axis of the chamber for providing a channel for allowing the coolant to enter one side of the chamber and to exit through the other side. The ceramic window load further includes a slab fabricated from ceramic or other suitable refractory material selected to have a dielectric constant intermediate to the dielectric constants of air and the liquid coolant. The ceramic slab is generally brazed within the waveguide between the air filled waveguide and coolant filled chamber using conventional brazing techniques and provides a wall which is somewhat transparent to the electromagnetic energy. Although some of the electromagnetic energy is absorbed and dissipated within the ceramic slab window, it is generally desired that as much of the energy incident upon the load be dissipated in the coolant medium. The ceramic window load of this type may, in addition, further include one or more matching elements for providing an impedance match between the characteristic impedance of the air-filled waveguide and the energy absorbing coolant chamber. The impedance and the position within the waveguide will generally determine whether the elements are capacitive or inductive elements. Because the matching elements are generally frequency sensitive and although impedance matching elements increase the amount of energy delivered to the coolant at one frequency, the ability to absorb energy at other frequencies is typically degraded. In effect, the matching element generally provides a waveguide termination with a narrow bandwidth frequency response.

Another problem with the ceramic window load is that, as energy is absorbed by the coolant, the temperature of the coolant increases. This rise in temperature changes the dielectric constant and loss tangent characteristics of the coolant such that the effectiveness of any impedance matching elements is substantially reduced.

In addition, manufacturing costs for ceramic window water loads are relatively high. This is generally attributed to the brazing operations required for providing the ceramic slab in the waveguide and for providing the fluid-tight coolant compartment to the waveguide.

Further, in applications where the waveguide has corners, such as in a rectangular waveguide, air bubbles can accumulate in the corners of the coolant chamber such that the impedance of the energy absorbent chamber fluctuates. This fluctuation may reduce the amount of energy provided to the resistive element of the termination.

Another waveguide termination commonly used in high power applications is the glass water load. The glass water load includes a hollow glass tube having a uniform cross-section inserted through the narrow walls of the waveguide at a shallow angle. Circulating water or other suitable coolant is then passed through the tube for dissipating the incident power. Configured in this way, the reflections are minimized and accordingly the standing wave ratio is relatively low. The amount of power that can be dissipated in such a water load is related to the type of coolant used, the flow rate of the coolant, and the cross-sectional area of the tube.

One problem with the glass water load waveguide termination is that because the glass tube is inserted at a shallow angle, the tube is generally required to be quite long which presents problems of mechanical fit in applications where there is limited space. Also, in applications where a very low VSWR is required, the cross-sectional area must be kept to a minimum, which subsequently limits volume flow and power handling capability. Further, in applications where the waveguide termination may be subjected to mechanical shock the fragile glass tube can be easily broken.

In all of the above described high power waveguide terminations, voltage standing wave ratios of at least 1.05:1 are achievable, but usually at the expense of providing frequency sensitive tuning structures or exhaustive empirical attempts at repositioning the energy absorbent element. However, even in situations where an optimum position of the absorbent element is determined and can be repeated, an increased VSWR can result from deviations in the internal dimensions of the waveguide and the absorbent element during the manufacturing process of these elements, nullifying the determined optimum position. Refining the manufacturing specifications to require very high tolerance piece parts will correspondingly increase manufacturing costs. Moreover, an increased VSWR can also be caused by the lateral displacement between the two flanged assemblies.

SUMMARY OF THE INVENTION

In accordance with the present invention, an apparatus includes a plate having an aperture and an electromagnetic energy absorbent element disposed through the aperture of the plate. The apparatus further includes means, coupled to the plate, for adjusting a lateral position of the absorbent element with respect to the plate. With such an arrangement, the means allows changing the position of the energy absorbent element such that when the apparatus is disposed within a waveguide and electromagnetic energy is incident to the waveguide apparatus, a relatively low voltage standing wave ratio can be provided by adjusting the position of the energy absorbent element relative to the shorting plate.

In accordance with a further aspect of the invention, an apparatus includes a hollow waveguide having a length, a cross-sectional periphery, and an end portion. The apparatus further includes a plate having a plurality of elongated holes and a first aperture and a waveguide shorting plate disposed between the end portion of the waveguide and the plate wherein the shorting plate has a second aperture coaxial with the first aperture and a nonuniform thickness. The apparatus further includes an electromagnetic energy absorbent element disposed through the first and second apertures and within the hollow waveguide, the energy absorbent element having a length, and a bore extending substantially through the length of the absorbent element, with the absorbent element being disposed at a lateral offset from the center of the waveguide. The energy absorbent element further has a first portion having a first dimension, an end portion having a second dimension being smaller than the first dimension, and a second portion having a third dimension which gradually tapers from the first dimension to the second dimension. The apparatus further includes means, coupled to the absorbent element, for providing a liquid coolant to the bore of the element and a plurality of screws for coupling the plate and the means for providing a liquid coolant to the waveguide shorting plate. The plate having the elongated holes in combination with the plurality of screws allows the lateral position of the absorbent element to be adjusted with respect to the waveguide width. With such an arrangement, a high power liquid cooled waveguide termination is provided having a plate for adjusting the lateral position of the energy absorber within the waveguide. The electromagnetic absorbent element has a dimension which tapers from a first portion to an end portion for providing an absorbent element which minimizes reflections of incoming electromagnetic waves incident to the waveguide termination. The absorbent element being disposed at a lateral offset from the center of the waveguide, in combination with the nonuniform thickness of the plate allows a greater surface area of the tapered absorbent element to be presented to incoming electromagnetic waves incident to the termination thereby providing more absorption of the wave energy. Concomitantly, this characteristic reduces localized heating to the absorbent element which would otherwise be detrimental to the life of the absorbent element.

In accordance with a further aspect of the invention, an apparatus includes a waveguide shorting plate having a first aperture, a housing having a plurality of ports, a plate disposed between the shorting plate and housing having a plurality of elongated holes and a second aperture, and a corresponding plurality of fasteners coupling the plate and housing to the waveguide shorting plate. The apparatus further includes an electromagnetic energy absorbent element disposed through the first and second apertures, having a length, a bore extending substantially the length of the absorbent element, and a lipped portion disposed at the open end of the absorbent element and a tube having a first end coupled to a first one of the plurality of ports, a first portion disposed through a second one of the plurality of ports and a second end disposed within the bore of the absorbent element, such that a liquid coolant provided to the first one of the plurality of ports passes from the first end to the second end of the tube and is expelled from the housing through a third one of the plurality of ports. The apparatus further includes first sealing means, disposed between the lipped portion of the absorbent element and the plate, for providing an air-tight seal between the element and the plate, second sealing means, disposed between the lipped portion of the absorbent element and the housing, for providing an air-tight seal between the element and housing, and third sealing means, disposed between the plate and the waveguide shorting plate, for providing a fluid-tight, air-tight seal between the plate and shorting plate. With such an arrangement, a self-contained, fluid and air-tight liquid-cooled energy absorbent element for use in a waveguide termination is provided. Liquid coolant provided to the first one of the plurality of ports passes from the first end to the second end of the tube and is expelled from the coolant housing through a third one of the plurality of ports. The first and third sealing means provide air-tight seals between the absorbent element and the plate and the plate and the waveguide shorting plate, respectively. The second sealing means provides both a fluid-tight and air-tight seal between the absorbent element and the housing. Further, the self-contained unit allows testing of certain characteristics of the termination external to the waveguide.

BRIEF DESCRIPTION OF THE DRAWINGS

The foregoing features of this invention, as well as the invention itself, may be more fully understood from the following detailed description of the drawings, in which.

DESCRIPTION OF THE PREFERRED EMBODIMENTS

Figures 1, 1A:
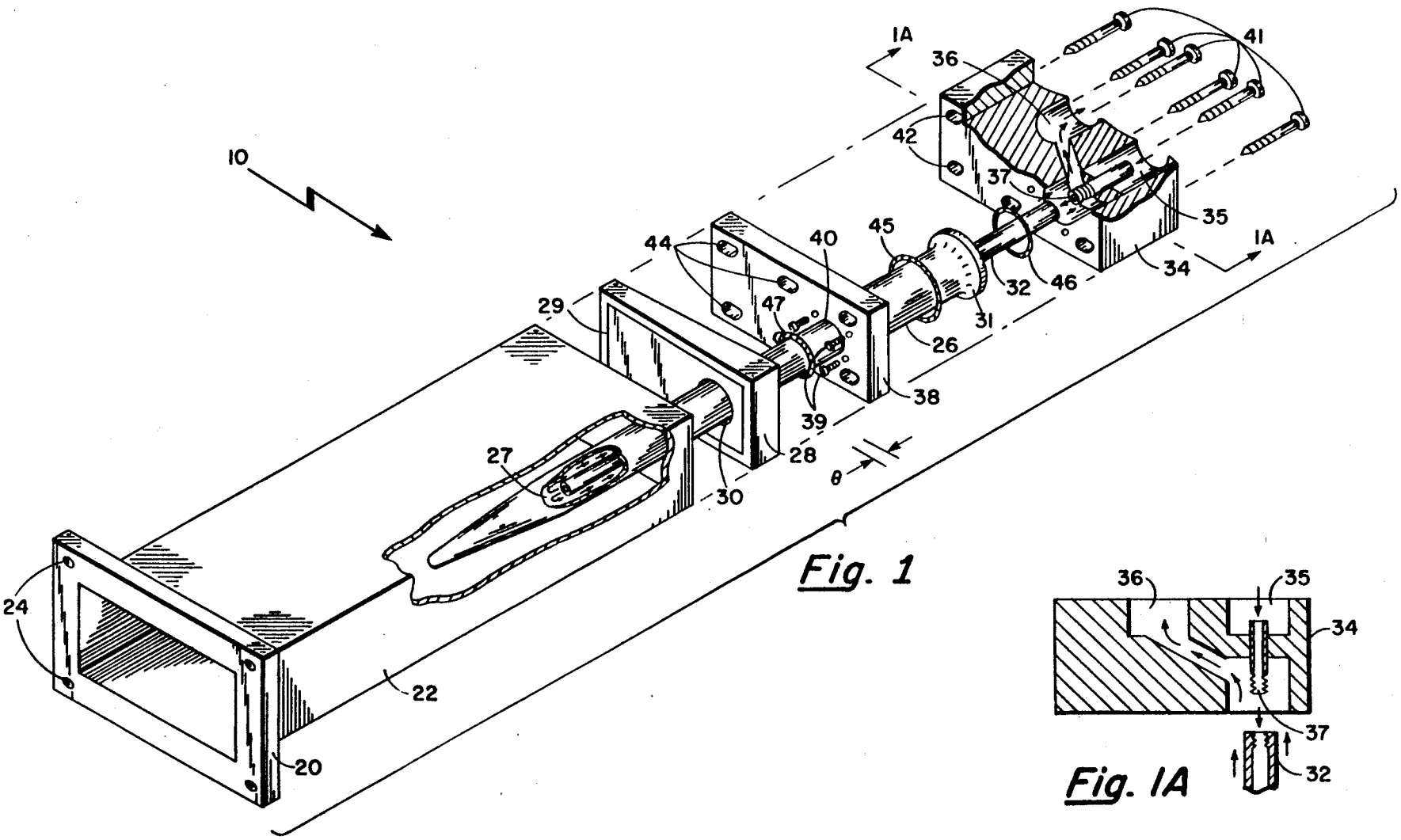
FIG. 1 is an exploded, somewhat diagrammatical, isometric view of a high power adjustable waterload.
FIG. 1A is a cross-sectional view of a portion of FIG. 1 taken along lines 1A—1A.

Referring now to FIG. 1, a high power adjustable liquid-cooled waveguide termination 10 is shown to include a mounting flange 20 attached to a waveguide housing enclosure 22. The mounting flange 20 allows the termination to mate with other waveguide devices such that when they are coupled, a continuous waveguide transmission path is provided. The flange 20 generally includes a plurality of holes 24 disposed along the outer periphery of the mounting surface for holding bolts or screws (not shown) generally required for providing a tight mating surface to a flange of an adjoining waveguide device. In some high power. applications it may be desired to use an appropriate choke flange design for reducing the possibility of arcing due to imperfect or erratic contact between flanges.

The waveguide housing 22, here rectangular in cross-section is shown having a predetermined height and width generally dependent on the frequency of operation of the device.

The waveguide housing 22 further includes a shorting plate 28 for preventing leakage of electromagnetic energy out of or into the waveguide structure. The shorting plate 28, here has disposed on a broad surface, a channel 29 having a thickness substantially that of the thickness of the waveguide walls for engaging the waveguide housing 22. The shorting plate 28, as well as the aforementioned waveguide flange 20 are generally fixed to the housing 22 using conventional soldering or brazing techniques. Configured in this way a waveguide housing is provided having an open end for allowing electromagnetic energy to enter and a closed end for reflecting any electromagnetic energy not absorbed within the termination 10. The shorting plate 28 further has a through aperture 30 to be discussed later.

The high power waveguide termination 10 further includes an electromagnetic energy absorbent element 26 having a portion that, has a generally conical shape with a cross-section at one end tapering to a reduced cross-section at the other end. As is known in the art, the gradual tapering of the cross-section of the absorbent element minimizes reflections and provides a low input standing wave ratio, as long as the taper length is much greater than the operating wavelength. As is also known in the art, most of the electromagnetic transmission in rectangular waveguide makes use of the $TE_{10}$ mode, called the dominant mode. In this mode, the electrical field intensity is greatest along the center line of the broad wall of the waveguide. This characteristic, therefore, makes it undesirable to have the conically shaped element 26 lie along this same axis, where the field intensity would be concentrated over a relatively small area of the element. It is desired that the tapered absorbent element be introduced within the waveguide such that the energy absorbent element is allowed to gradually intercept the incoming electromagnetic waves. Accordingly, the through aperture 30 is offset to one side of the plate to allow the absorbent element to pass through the shorting plate 28. The portion of the absorbent element having the smallest cross-section is allowed to be offset from the centerline of the waveguide where the electric field intensity is substantially reduced and as the cross-section of the element gradually increases, the element absorbs a correspondingly greater portion of the higher intensity field. Thus, the tapered element gradually absorbs the energy over its surface area while concurrently providing a low VSWR to the energy source. Since the waveguide shorting, plate 28 should prevent leakage of the electromagnetic energy from the end portion of the waveguider housing 22, the aperture 30 has a dimension substantially that of a dimension of the portion of the absorbent element disposed within the aperture but provides a small space 30' about the absorbent element 26 as shown in FIG. 1.

The absorbent element 26 further includes a bore 27 extending substantially the length of the element, for enclosing a liquid coolant such as water or ethylene glycol, used in cooling the element. The absorbent element 26 is fabricated from a relatively microwave transparent material having sufficient rigidity and a relatively low dielectric constant. The absorbent element 26 is shown here to have a circular cross-section, however, in some applications elliptical or other cross-sections may be desirable. The absorbent element 26 further includes a generally flat lipped portion 31 at the open end having a surface for allowing the element to be easily retained and sealed within the termination assembly. It is generally desired that the walls of the absorbent element be relatively thin so that as much of the energy is provided to the coolant. However, the wall is required to be sufficiently thick for supporting the liquid coolant which is typically provided under substantial pressure.

A hollow tube 32 is disposed within the bore 27 of the absorbent element 26 for providing the liquid coolant to the element. The tube is here, fabricated from Teflon, a trademark of E.I. du Pont de Nemours, Inc., Wilmington, Del., but could be manufactured from other low dielectric, relatively high melting point and easily machinable materials. The hollow tube 32 is coupled to a flow header assembly 34 which provides for the circulation of a liquid coolant within the absorbent element 26.

Because the energy absorbent element 26 is generally desired to be offset to one side of the waveguide housing 22, it may be desired to redirect the position of the end portion of the hollow tube 32 within the bore of the element such that the agitation of the coolant is greater along the portion of the element 26 which is closer to the center of the waveguide housing. As previously stated, the electrical field intensity is greatest along the center line of the waveguide. One method of redirecting the end portion of the tube is to provide a protruding arm along the outer portion of the tube, at a predetermined distance along the length of tube and having sufficient length for offsetting the tube from the center of the bore. In high power applications and/or in applications where the flow rate is limited, additional coolant outlet holes may be provided along the length of the tube 32 for increasing the coolant agitation at predetermined locations along the length of the absorbent element 26.

Flow header assembly 34 abuts the energy absorbent element 26 and is coupled to the hollow tube 32 for providing the coolant to the element 26 and for directing the heated coolant out of the termination element.

Referring now to FIG 1A, the flow header assembly 34 includes here, a pair of ports for attaching appropriate fittings, such as plumbing fixtures to the assembly. An inlet port 35 includes a header water fitting 37 for coupling to the hollow tube 32. The flow assembly 34 is channelized such that when coupled to the hollow tube 32 and absorbent element 26, coolant under pressure is provided through the tube and down the length of the element 26. The coolant exits the end of the hollow tube 32 and is forced to flow back to the header assembly along the portion of the absorbent element between the tube and the inner wall of the element. The heated coolant then exits an outlet port 36 where it is allowed to cool for recirculation through the termination 10.

An adjustable seal plate 38 is disposed between the waveguide shorting plate 28 and the flow header assembly 34. The seal plate 38 has a plurality of elongated holes 44 which receive a corresponding plurality of header retaining fasteners, here screw 41 which allows the position of the seal plate 38 and hence the position of the absorbent element 26 to be changed within the waveguide housing 22 as will be further discussed. As was described in conjunction with the shorting plate 28, the seal plate 38 similarly includes a seal plate aperture 40 generally aligned with the shorting plate aperture 30 for allowing the absorbent element 26 to pass through the seal plate 38. The adjustable seal plate 38 is, here rigidly fixed to the flow header assembly 34 using a plurality of seal plate screws 39 which are disposed in threaded holes disposed within the header assembly. The plurality of header assembly screws 41 pass through the flow header assembly 34 and the adjustable seal plate 38 to mate with threaded holes disposed in the waveguide shorting plate 28.

As was discussed previously, the absorbent element 26 is offset to one side of the waveguide housing 22 such that the element gradually intercepts the incoming electromagnetic energy. In conjunction with this feature, the waveguide shorting plate 28 may have a nonuniform thickness; that is the length on one side of the shorting plate is longer than the other. The shorting plate 28 has a surface that is disposed at a bevel angle $\theta$ and, when brazed to the waveguide housing 22, allows the absorbent element 26 to be introduced obliquely within the waveguide at the same angle $\theta$ with respect to the waveguide sidewall. The beveled shorting plate further augments those features and advantages described in conjunction with the offset aperture 30 of the shorting plate. Introducing the absorbent element 26 within the waveguide 22 at the oblique angle $\theta$ allows the element to intercept somewhat more of the incoming incident power while maintaining a relatively low VSWR of the termination. In one preferred embodiment, the surface of the waveguide shorting plate 28 has a surface having a bevel angle $\theta$ approximate to an angle of a linear taper of the absorbent element 26. When disposed in the waveguide housing 22, the taper is approximately parallel with a sidewall of the housing. A waveguide termination not having the element disposed within the housing at an angle, may require an absorbent element having a longer length for providing the same level of attenuation. This would generally result in a waveguide termination with a greater overall length, undesirable in those applications where available space is a concern.

Through holes 42, 44 disposed, in the header assembly 34 and the adjustable seal plate 38 respectively for retaining the plurality of header assembly screws 41 are elongated, generally along the axis of the broad wall. In this way, the flow header assembly 34, seal plate 38, and the interposed absorbent element 26 as an assembled unit is allowed to have its lateral position adjusted.

A pair of O-rings 45, 46 are disposed on both sides of the flat-lipped portion 31 of the absorbent element 26, for providing a tight seal between the element 26 and both the adjustable seal plate 38 and header assembly 34. An additional O-ring 47 is disposed around the aperture 30 for providing a seal between the seal plate 38 and waveguide shorting plate 28. O-rings 45, 46, 47 are also generally required in applications where the power levels may require that the waveguide be pressurized with an inert gas such as $SF_6$ (sulfur hexaflouride) or in applications where the waveguide termination is evacuated. As is known in the art, in extreme high power applications, certain gaseous insulators having increased dielectric strength characteristics provide better protection against electrical arcing than air. The O-rings 45, 46, 47 are, here fabricated from a silicon rubber, manufactured by Parker-Hannifin Corp., Cleveland, Ohio, P/N 2-218, 2-129, and 2-029.

In operation, electromagnetic energy having continuous wave power levels in excess of 10 kilowatts (KW) and as high as 30 KW watts or peak power levels as high as 8 megawatts (MW) enter the flanged end of the waveguide termination 10. The energy waves propagate along the longitudinal length of the waveguide housing 22 without resistance until they are intercepted by the tapered energy absorbent element 26. The tapered element, here, is 9.25" long and is fabricated from a cross-linked polystyrene material, known as Rexolite manufactured by Polymer Corporation, Reading, Pa., Product Number Q200.5. This material has a dielectric constant of approximately 2.55 and is relatively microwave transmissive. The wall thickness of the absorbent element 26 is here, determined to be approximately 0.125" thick, sufficient for maintaining liquid coolant pressurized to levels as high as 240 psig. For a 9.25" long element required to dissipate an average power level of 10 KW, a flow rate of approximately 3.0 gallons per minute would generally be required. For higher average power levels, correspondingly higher flow rates would be required. An absorbent element 26 fabricated from a material such as Rexolite and not having an adequate liquid flow rate would in most cases crack or burst from excessive heat.

Figure 2:
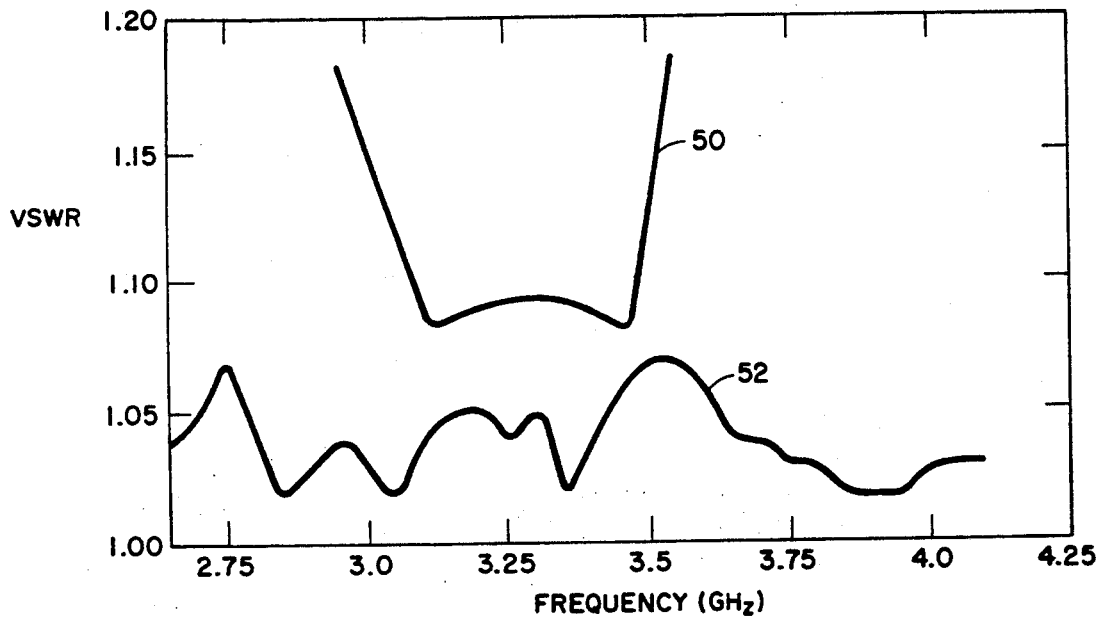
FIG. 2 is a graph of voltage standing wave ratio (VSWR) versus frequency in units of GHz showing the relationship between VSWR and frequency for a typical prior art high-power waterload and a typical high power adjustable waterload in accordance with the present invention.

Referring now to FIG. 2, there is shown a typical representation of voltage standing wave ratio (Y-axis)

as a function of frequency in GHz (X-axis) for a typical liquid cooled ceramic block window termination, curve 50, and a typical high power adjustable liquid cooled termination constructed in accordance with the present invention, curve 52.

The typical prior art high power liquid cooled ceramic block window termination includes a hollow rectangular waveguide having a fluid-tight coolant chamber portion disposed within an end portion of the waveguide and adjacent to the shorting plate of the termination. The ceramic block window load further includes a ceramic block having a height and width substantially the same as the internal dimensions of the waveguide brazed within the waveguide between the coolant chamber and the air-filled waveguide. The ceramic block termination further includes a matching susceptance disposed at a distance in front of the ceramic block approximately one quarter wavelength at the frequency of operation. The matching susceptance, here is a waveguide window element having a predetermined height and thickness. The window is generally brazed to the broad wall of the waveguide and has rounded edges for preventing arcing. Curve 50 representing the prior art is shown to have a relatively narrowband characteristic centered at about 3.25 GHz and having an optimum VSWR of 1.08:1.

Conversely, curve 52 representing the present invention has a worse case VSWR of 1.07:1 over the frequency range extending from 2.7 to 4.1 GHz with an optimum VSWR of 1.02:1.

One approach for optimizing the voltage standing wave ratio (VSWR) of the high power adjustable waveguide termination 10 includes coupling a SWR meter slotted line or other suitable device capable of measuring low standing wave ratios between the radiating high power source and the termination. At the operating frequency, the voltage standing wave ratio can be measured and if necessary the position of the absorbent element 26 can be adjusted by loosening the plurality of flow header assembly screws 41 and repositioning the seal plate 38. The operating frequency can be changed and VSWR observed to obtain an indication of the frequency response of the termination 10.

Because the dielectric constant and loss tangent characteristics of the coolant are somewhat related to the temperature of the coolant, it is generally necessary for the waveguide termination 10 to be tuned at the operating power level at which it is intended to be used. However, for safety reasons or if a power source with the needed power level is not available, the coolant may be heated to the proper temperature for simulating a particular power level and the termination thereupon can be tuned.

Before input power is actually provided to the waveguide termination 10, it may be necessary to provide a liquid flow to purge the inner portion of the energy absorbent element 26 of air or other gases present to eliminate any air pockets or bubbles that may become trapped within the element. For the aforementioned 9.25" long element 26, a flow rate of approximately 3.0 gallons/minute would generally be required, while supporting the element in a generally horizontal position.

Modifications of the preferred embodiment will be apparent to those skilled in the art. For example, an alternate embodiment to the above described waveguide termination may include a waveguide shorting plate 28 having a uniform thickness and an adjustable seal plate 38 having a nonuniform thickness. In this configuration, the absorbent element 26 is still introduced within the waveguide housing 22, at an oblique angle, nevertheless the aperture 30 of the shorting plate is still desired to be coaxial with the seal plate aperture 40 such that the absorbent element 26 is allowed to be disposed therethrough. Providing such a configuration is realizable, however manufacturing costs may be higher.

Having described a preferred embodiment of the invention, it will now become apparent to one of skill in the art that other embodiments incorporating their concepts may be used. It is felt, therefore, that the embodiment should not be limited to the disclosed embodiment, but rather should be limited only by the spirit and scope of the appended claims.

What is claimed is:

1. An apparatus comprising:

a plate having a first electrically conductive surface, a second opposing surface, and an aperture;

a member having a surface in contact with said second surface of said plate and an aperture disposed through said member;

an electromagnetic energy absorbent element, comprised of a non-electrically conductive material, disposed through the aperture of the plate and the aperture of the member, said absorbent element having an initial position with respect to said plate; and means, including the member, for adjusting the initial position of the absorbent element with respect to the plate.

2. The apparatus of claim 1 wherein the apparatus further comprises:

a plurality of fasteners coupling the means for adjusting the position of the absorbent element to the plate; and wherein the means for adjusting further includes the member having a corresponding plurality of elongated holes to permit adjustment of the position of the member and the absorbent element with respect to the plate.

3. The apparatus of claim 2 further comprising a hollow waveguide having a length, a cross-sectional periphery and an end portion with the end portion thereof coupled to the plate.

4. The apparatus of claim 3 wherein the energy absorbent element is disposed through the aperture of the plate and the energy absorbent element is disposed at a lateral offset from the center of the waveguide.

5. The apparatus of claim 4 wherein the plate has a nonuniform thickness such that the energy absorbent element is disposed within the waveguide at an oblique angle relative to a sidewall of the waveguide.

6. The apparatus of claim 1 wherein the electromagnetic energy absorbent element further has a first portion having a first dimension, an end portion having a second dimension being smaller than the first dimension, and a second portion having a third dimension which gradually tapers from the first dimension to the second dimension.

7. An apparatus comprising:

a hollow waveguide having a length, a cross-sectional periphery and an end portion;

a plate having a plurality of elongated holes and a first aperture;

a waveguide shorting plate disposed between the end portion of the waveguide and the plate wherein the shorting plate has a nonuniform thickness and a second aperture coaxial with the first aperture;

an electromagnetic energy absorbent element disposed through the first and second apertures and within the hollow waveguide, said energy absorbent element having a length, and a bore extending substantially through the length of the absorbent element, with said absorbent element being disposed at a lateral offset from the center of the waveguide and wherein the energy absorbent element further has a first portion having a first dimension, an end portion having a second dimension being smaller than the first dimension, and a second portion having a third dimension which gradually tapers from the first dimension to the second dimension;

means, coupled to said absorbent element, for providing a liquid coolant to the bore of the absorbent element;

a plurality of screws for coupling the plate and the means for providing a liquid coolant to the waveguide shorting plate; and wherein the plate having the elongated holes in combination with the plurality of screws allows the lateral position of the absorbent element to be adjusted with respect to the waveguide width.

8. The apparatus of claim 6 wherein said means for providing a liquid coolant to the absorbent element comprises:

a housing having first, second, and third ports; and a tube disposed through the first port, said tube having a first end coupled to the second port, and a second end disposed within the bore of the absorbent element, such that liquid coolant provided to the second port and through said tube, is expelled from the second end of the tube and passes between said tube and inner portions of said energy absorbent element and through the third port of said housing.

9. The apparatus of claim 8 wherein the hollow waveguide is rectangular.

10. The apparatus of claim 9 wherein said liquid coolant includes water.

11. An apparatus comprising:

a waveguide shorting plate having a first aperture;

a housing having a plurality of ports;

a plate disposed between the waveguide shorting plate and housing having a plurality of elongated holes and a second aperture;

a corresponding plurality of fasteners coupling said plate and housing to the waveguide shorting plate;

an electromagnetic energy absorbent element disposed through said first and second apertures, having a length, a bore extending substantially the length of the absorbent element, and a lipped portion disposed at the open end of said absorbent element, wherein the energy absorbent element is disposed through said first and second apertures;

a tube having a first end coupled to a first one of the plurality of ports, a first portion disposed through a second one of the plurality of ports and a second end disposed within the bore of the absorbent element, such that a liquid coolant provided to the first one of the plurality of ports passes from the first end to the second end of the tube and is expelled from the housing through a third one of the plurality of ports;

first sealing means, disposed between the lipped portion of the absorbent element and the plate, for providing an air-tight seal between the element and the plate;

second sealing means, disposed between the lipped portion of the absorbent element and the housing, for providing a fluid-tight, air-tight seal between the element and housing; and third sealing means, disposed between the plate and the waveguide shorting plate, for providing an air-tight seal between the plate and shorting plate.

12. The apparatus as recited in claim 11 wherein said first, second, and third sealing means are O-rings.

13. The apparatus of claim 12 further comprising a hollow waveguide having a length, a cross-sectional periphery and an end portion, with said end portion thereof coupled to the waveguide shorting plate.

14. The apparatus of claim 13 wherein said electromagnetic energy absorbent element is disposed at a lateral offset from the center of the waveguide and said plate has a nonuniform thickness such that said absorbent element is disposed within the waveguide at an oblique angle relative to a sidewall of the waveguide.

* * * * *